US010138058B2

(12) United States Patent
Seaburg, Sr.

(10) Patent No.: US 10,138,058 B2
(45) Date of Patent: Nov. 27, 2018

(54) WASTE CONTAINER TRANSPORT DEVICE

(71) Applicant: Great Day, Inc., Tallulah, LA (US)

(72) Inventor: Stephen L. Seaburg, Sr., Traverse City, MI (US)

(73) Assignee: GREAT DAY, INC., Tallulah, LA (US)

( * ) Notice: Subject to any disclaimer, the term of this patent is extended or adjusted under 35 U.S.C. 154(b) by 311 days.

(21) Appl. No.: 14/820,087

(22) Filed: Aug. 6, 2015

(65) Prior Publication Data

US 2016/0039353 A1 Feb. 11, 2016

Related U.S. Application Data

(60) Provisional application No. 61/999,789, filed on Aug. 6, 2014.

(51) Int. Cl.
*B65F 1/14* (2006.01)

(52) U.S. Cl.
CPC ..... *B65F 1/1468* (2013.01); *B65F 1/1473* (2013.01)

(58) Field of Classification Search
CPC ..... B65F 1/1473; B65F 1/1468; Y10T 403/32581; Y10T 403/32901; Y10T 403/32057
USPC ..... 414/462–466; 403/116
See application file for complete search history.

(56) References Cited

U.S. PATENT DOCUMENTS

| | | | | | |
|---|---|---|---|---|---|
| 4,400,129 | A * | 8/1983 | Eisenberg | A61G 3/0209 | 224/505 |
| 4,798,511 | A * | 1/1989 | Kaczmarczyk | E02F 3/36 | 248/52 |
| 5,961,272 | A * | 10/1999 | Short | B65F 1/1468 | 224/282 |
| 6,134,819 | A * | 10/2000 | McClain | G09F 7/20 | 248/219.2 |
| 7,217,078 | B2 * | 5/2007 | Short | B65F 1/1468 | 224/282 |
| 7,494,312 | B2 * | 2/2009 | Valette | E04F 21/1822 | 280/79.7 |
| 2008/0101899 | A1 * | 5/2008 | Slonecker | B60D 1/00 | 414/462 |
| 2014/0271045 | A1 * | 9/2014 | Swanson | E21B 19/15 | 414/22.62 |

* cited by examiner

*Primary Examiner* — Lynn E Schwenning
(74) *Attorney, Agent, or Firm* — Haynes and Boone, LLP

(57) ABSTRACT

An apparatus, kit, and method for transporting a waste container. In an exemplary embodiment, the apparatus includes a base member; a latch housing connected to the base member; a cantilever arm hingedly connected to the base member and adapted to be coupled to the waste container, wherein, when the cantilever arm is coupled to the waste container, the cantilever arm is adapted to pivot about the base member between a loading configuration and a transporting configuration; and a latch hingedly connected to the cantilever arm and adapted to slidingly engage the latch housing when the cantilever arm is pivoted about the base member, the latch being actuatable between a latched configuration and an unlatched configuration.

19 Claims, 18 Drawing Sheets

WASTE CONTAINER TRANSPORT DEVICE

CROSS-REFERENCE TO RELATED APPLICATION

This application claims priority to, and the benefit of the filing date of, U.S. patent application No. 61/999,789, filed Aug. 6, 2014, the entire disclosure of which is hereby incorporated herein by reference.

TECHNICAL FIELD

The present disclosure relates generally to waste container transport and, more specifically, to a waste container transport device adapted to be connected to a transport vehicle.

BACKGROUND

During the handling, transporting, and processing of waste, various devices may be used in connection with the handling and transporting of waste containers. However, the transport of waste containers by individuals is often done by hand via, for example, commercially available wheeled waste containers. The transport of such waste containers by hand may be difficult for a number of reasons such as, for example, the weight of the waste container and/or the contents thereof, and the distance, weather, and/or road conditions over which the waste container must be transported, among others. Further, in order to address these difficulties, the waste container often must be lifted by the individual and placed on a transport vehicle, causing considerable physical strain. Therefore, what is needed is an apparatus, system, and/or method that addresses one or more of the foregoing issues, among others.

SUMMARY

In a first aspect, there is provided an apparatus for transporting a waste container, the apparatus including a base member; a latch housing connected to the base member; a cantilever arm hingedly connected to the base member and adapted to be coupled to the waste container, wherein, when the cantilever arm is coupled to the waste container, the cantilever arm is adapted to pivot about the base member between a loading configuration and a transporting configuration; and a latch hingedly connected to the cantilever arm and adapted to slidingly engage the latch housing when the cantilever arm is pivoted about the base member, the latch being actuatable between a latched configuration and an unlatched configuration.

In an exemplary embodiment, when the cantilever arm is in the loading configuration, the waste container is adapted to be coupled to the cantilever arm while the waste container is situated on a surface location; and, when the cantilever arm is in the transporting configuration, the waste container is elevated above the surface location by the cantilever arm.

In another exemplary embodiment, the latch housing includes a guide plate connected to the base member; a slot formed through the guide plate and defining first and second end portions; and a notch formed through the guide plate at the first end portion of the slot, the notch extending downwardly from the slot.

In yet another exemplary embodiment, the latch includes an elongated latch plate hingedly connected to the cantilever arm; and a sliding pin disposed within at least one of the slot and the notch, and adapted to slidingly engage the guide plate of the latch housing.

In certain exemplary embodiments, when the latch is in the unlatched configuration, the sliding pin is disposed within the slot and permitted to slide longitudinally between the first and second end portions thereof, thereby permitting the cantilever arm to rest in the loading configuration; and, when the latch is in the latched configuration, the sliding pin is disposed within the notch, thereby maintaining the cantilever arm in the transporting configuration.

In an exemplary embodiment, the apparatus further includes an actuating mechanism connected to the latch housing and adapted to actuate the latch between the latched configuration and the unlatched configuration, the actuating mechanism including a spring arm connected to the latch housing and adapted to contact the sliding pin of the latch; an actuating lever connected to the latch housing; and a spring coupled between the actuating lever and the spring arm, wherein the actuating lever is adapted to place the spring in tension.

In another exemplary embodiment, when the spring is placed in tension by the actuating lever, the spring arm is adapted to urge the sliding pin of the latch out of the notch and into the slot, thereby actuating the latch from the latched configuration to the unlatched configuration.

In yet another exemplary embodiment, the latch housing further includes a protrusion formed on the guide plate between the slot and the notch, the protrusion being adapted to prevent, or at least obstruct, the sliding pin of the latch from being urged out of the notch and into the slot by the spring arm of the actuating member.

In a second aspect, there is provided a kit for transporting a waste container, the kit including a base member; a latch housing adapted to be connected to the base member; a cantilever arm adapted to be hingedly connected to the base member and adapted to be coupled to the waste container, wherein, when the cantilever arm is coupled to the waste container, the cantilever arm is adapted to pivot about the base member between a loading configuration and a transporting configuration; and a latch adapted to be hingedly connected to the cantilever arm and adapted to slidingly engage the latch housing when the cantilever arm is pivoted about the base member, the latch being actuatable between a latched configuration and an unlatched configuration.

In an exemplary embodiment, the latch housing includes a guide plate adapted to be connected to the base member; a slot formed through the guide plate and defining first and second end portions; and a notch formed through the guide plate at the first end portion of the slot, the notch extending downwardly from the slot.

In another exemplary embodiment, the latch includes an elongated latch plate adapted to be hingedly connected to the cantilever arm; and a sliding pin adapted to be disposed within at least one of the slot and the notch and adapted to slidingly engage the guide plate of the latch housing.

In yet another exemplary embodiment, the kit further includes an actuating mechanism adapted to actuate the latch between the latched configuration and the unlatched configuration, the actuating mechanism including a spring arm adapted to be connected to the latch housing and adapted to contact the sliding pin of the latch; an actuating lever adapted to be connected to the latch housing; and a spring adapted to be coupled between the actuating lever and the spring arm, wherein the actuating lever is adapted to place the spring in tension.

In certain exemplary embodiments, when the cantilever arm is in the loading configuration, the waste container is adapted to be coupled to the cantilever arm while the waste container is situated on a surface location; and wherein, when the cantilever arm is in the transporting configuration, the waste container is elevated above the surface location by the cantilever arm.

In a third aspect, there is provided a method for transporting a waste container, the method including providing a transport device, the transport device including a base member, a latch housing connected to the base member, a cantilever arm hingedly connected to the base member and adapted to pivot thereabout, and a latch hingedly connected to the cantilever arm and adapted to slidingly engage the latch housing when the cantilever arm pivots about the base member; placing the cantilever arm in a loading configuration, in which the waste container is adapted to be coupled to the cantilever arm; coupling the waste container to the cantilever arm while the waste container is situated on a surface location; and placing the cantilever arm in a transporting configuration, in which the waste container is elevated above the surface location by the cantilever arm.

In an exemplary embodiment, the latch housing includes a guide plate connected to the base member, a slot formed through the guide plate and defining first and second end portions, and a notch formed through the guide plate at the first end portion of the slot, the notch extending downwardly from the slot; and the latch includes an elongated latch plate hingedly connected to the cantilever arm, and a sliding pin disposed within at least one of the slot and the notch, and adapted to slidingly engage the guide plate of the latch housing.

In another exemplary embodiment, placing the cantilever arm in the transporting configuration includes pivoting the cantilever arm about the base member until the sliding pin reaches the first end portion of the slot; and placing the latch in a latched configuration, in which the sliding pin is disposed within the notch, by permitting the sliding pin to fall into the notch when the sliding pin reaches the first end portion of the slot.

In yet another exemplary embodiment, placing the cantilever arm in the loading configuration includes placing the latch in an unlatched configuration, in which the sliding pin is disposed within the slot and permitted to slide longitudinally between the first and second end portions thereof; and pivoting the cantilever arm about the base member until the sliding pin abuts the second end portion of the slot.

In certain exemplary embodiments, the transport device further includes an actuating mechanism connected to the latch housing, the actuating mechanism including a spring arm connected to the latch housing and adapted to contact the sliding pin; an actuating lever connected to the latch housing; and a spring coupled between the actuating lever and the spring arm, wherein the actuating lever is adapted to place the spring in tension.

In an exemplary embodiment, placing the latch in the unlatched configuration includes placing the spring in tension via the actuating lever such that the spring arm urges the sliding pin of the latch out of the notch and into the slot, thereby actuating the latch from the latched configuration to the unlatched configuration.

In another exemplary embodiment, the latch housing further includes a protrusion formed on the guide plate between the slot and the notch, the protrusion being adapted to prevent, or at least obstruct, the sliding pin of the latch from being urged out of the notch and into the slot by the spring arm of the actuating member; and placing the latch in the unlatched configuration further includes applying an external force to the cantilever arm, thereby permitting the spring arm to urge the sliding pin of the latch out of the notch and into the slot.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
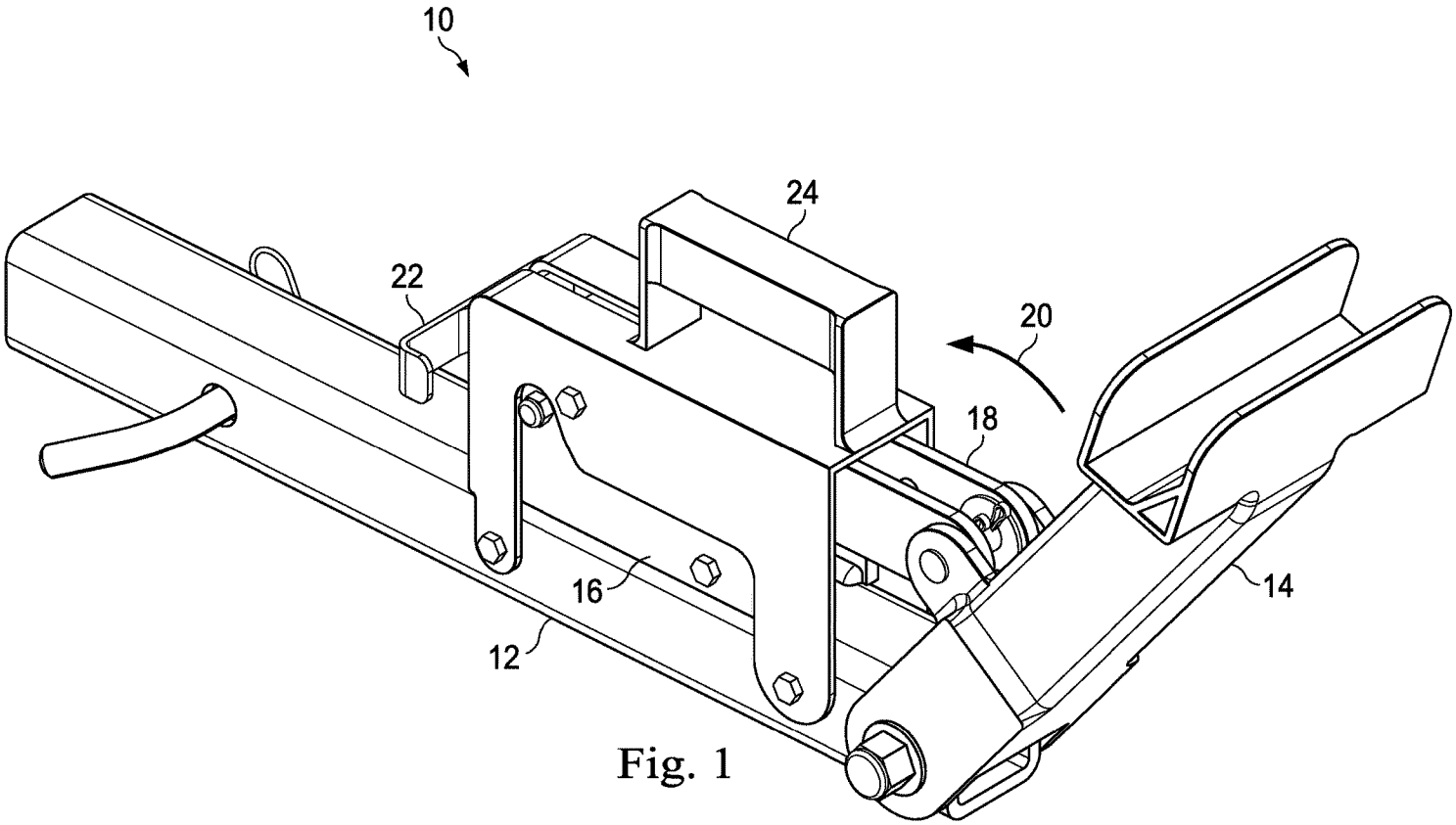
FIG. 1 is a perspective view of a waste container transport device, the waste container transport device including a base member, a cantilever arm, a latch housing, a latch, an actuating mechanism, and a shield, according to an exemplary embodiment.

In an exemplary embodiment, as illustrated in FIG. 1, a waste container transport device (also referred to herein as a Tote Caddy) is schematically illustrated and generally designated by the reference numeral 10. The waste container transport device 10 includes a base member 12 and a cantilever arm 14. The cantilever arm 14 is hingedly connected to the base member 12, and is adapted to pivot about the base member 12 between a loading configuration (shown in FIG. 1) and a transporting configuration, as will be discussed in further detail below. The base member 12 includes a latch housing 16 connected to a portion thereof. A latch 18 is hingedly connected to the cantilever arm 14, and is adapted to slidingly engage the latch housing 16 when the cantilever arm 14 is pivoted about the base member 12. The latch 18 is actuatable between a latched configuration and an unlatched configuration. The cantilever arm 14 is adapted to rest in the loading configuration (shown in FIG. 1) when the latch 18 is in the unlatched configuration, from which the cantilever arm 14 is pivotable about the base member 12 in an angular direction 20. However, the latch 18 is adapted to maintain the cantilever arm 14 in the transporting configuration when the latch 18 is in the latched configuration. An actuating mechanism 22 is accommodated within the latch housing 16. The actuating mechanism 22 is adapted to actuate the latch 18 between the latched configuration and the unlatched configuration, as will be discussed in further detail below. A shield 24 is connected to the base member 12, and covers respective portions of the latch housing 16, the latch 18, and the actuating mechanism 22.

Figure 2:
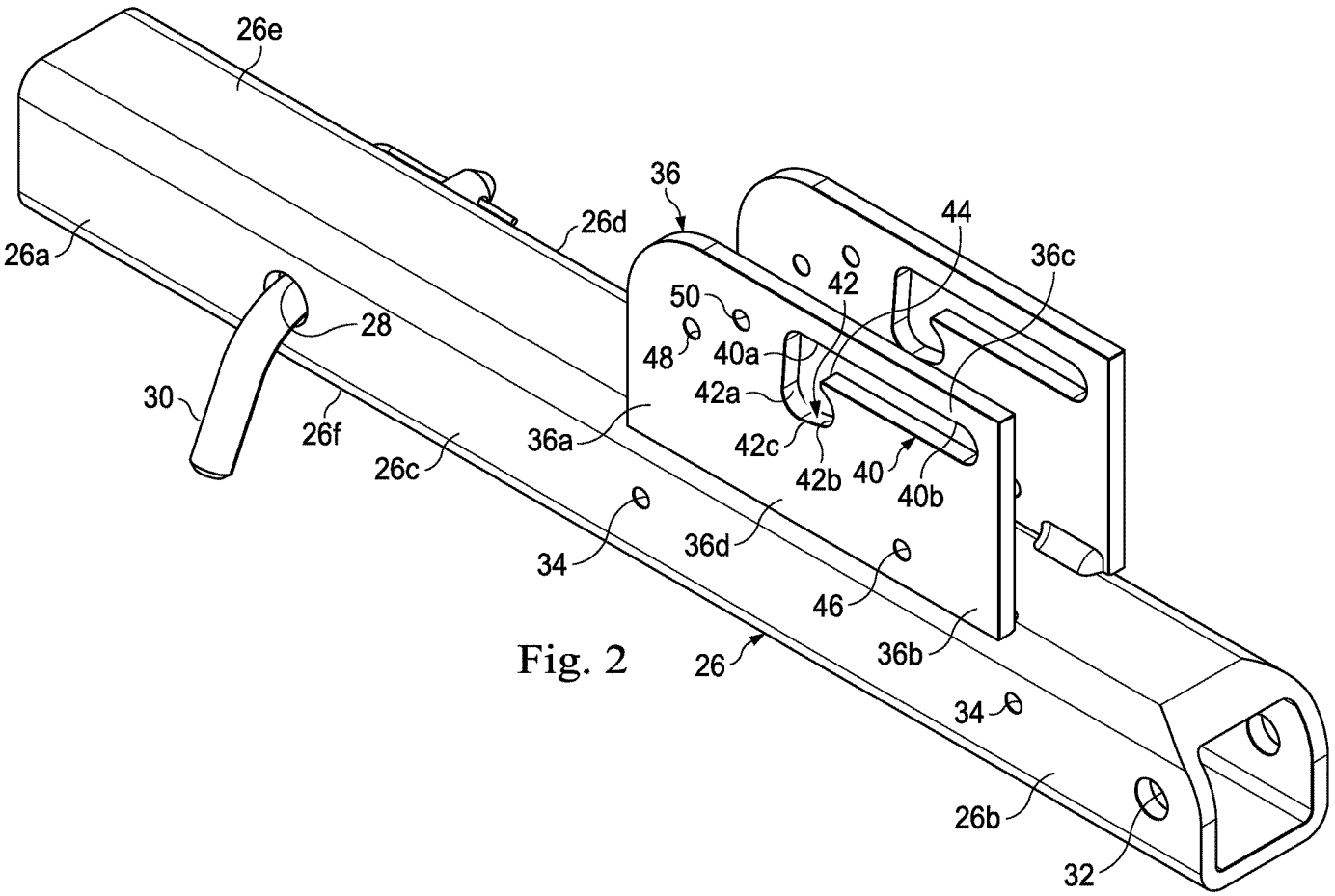
FIG. 2 is a perspective view of the base member and latch housing of FIG. 1, according to an exemplary embodiment.

In an exemplary embodiment, as illustrated in FIG. 2 with continuing reference to FIG. 1, the base member 12 is an elongated member such as, for example, a square tube 26. The square tube 26 defines opposing end portions 26*a* and 26*b*, side portions 26*c* and 26*d*, and top and bottom portions 26*e* and 26*f*, respectively. In several exemplary embodiments, the end portion 26*a* of the square tube 26 is adapted to be coupled to a receiver hitch that is connected to, for example, a transport vehicle. Accordingly, a pin-hole 28 is formed through the side portions 26*c* and 26*d* of the square tube 26 at the end portion 26*a* thereof. The pin-hole 28 is adapted to receive a pin 30. Additionally, an opening 32 is formed through the side portions 26*c* and 26*d* of the square tube 26 at the end portion 26*b* thereof. The opening 32 facilitates the hinged attachment of the cantilever arm 14 to the square tube 26, as will be discussed in further detail below. Finally, a pair of openings 34 are formed through the side portions 26*c* and 26*d* of the square tube 26, between the end portion 26*a* and the end portion 26*b* thereof.

The latch housing 16 includes a pair of guide plates 36 spaced in a parallel, or substantially parallel, relation and connected to the base member 12 at the top portion 26*e* of the square tube 26. Each of the guide plates 36 is generally rectangular in shape and defines opposing end portions 36*a* and 36*b*, a top portion 36*c*, and a bottom portion 36*d*. The end portions 36*a* and 36*b* of the guide plates 36 are connected to the base member 12 adjacent the respective openings 34 formed through the square tube 26. The guide plates 36 extend parallel, or substantially parallel, to the side portions 26*c* and 26*d* of the square tube 26. In addition to, or instead of, being connected to the top portion 26*e* of the square tube 26, the guide plates 36 may be connected to the respective side portions 26*c* and 26*d* of the square tube 26. A slot 40 is formed through each of the guide plates 36, proximate the top portion 36*c* thereof. The slot 40 defines opposing end portions 40*a* and 40*b*, and extends between the end portions 36*a* and 36*b* of the guide plate 36. A notch 42 is formed at the end portion 40*a* of the slot 40. The notch 42 extends downwardly from the end portion 40*a*, thereby defining opposing end portions 42*a* and 42*b*, and a bottom portion 42*c*. A protrusion 44 is defined on the guide plate 36 between the slot 40 and the notch 42, and adjacent the end portion 42*b* of the notch 42. An opening 46 is formed through each of the guide plates 36 below the slot 40, proximate the bottom portion 36*d* of the guide plate 36. Additionally, an opening 48 is formed through each of the guide plates 36 proximate the end portion 36*a* and the top portion 36*c* thereof. Finally, an opening 50 is formed through each of the guide plates 36 between the opening 48 and the slot 40, at a position above the opening 48. The guide plates 36 are oriented in relation to one another such that the respective slots 40, notches 42, protrusions 44, and openings 46, 48, and 50 thereof are substantially aligned.

Figure 3:
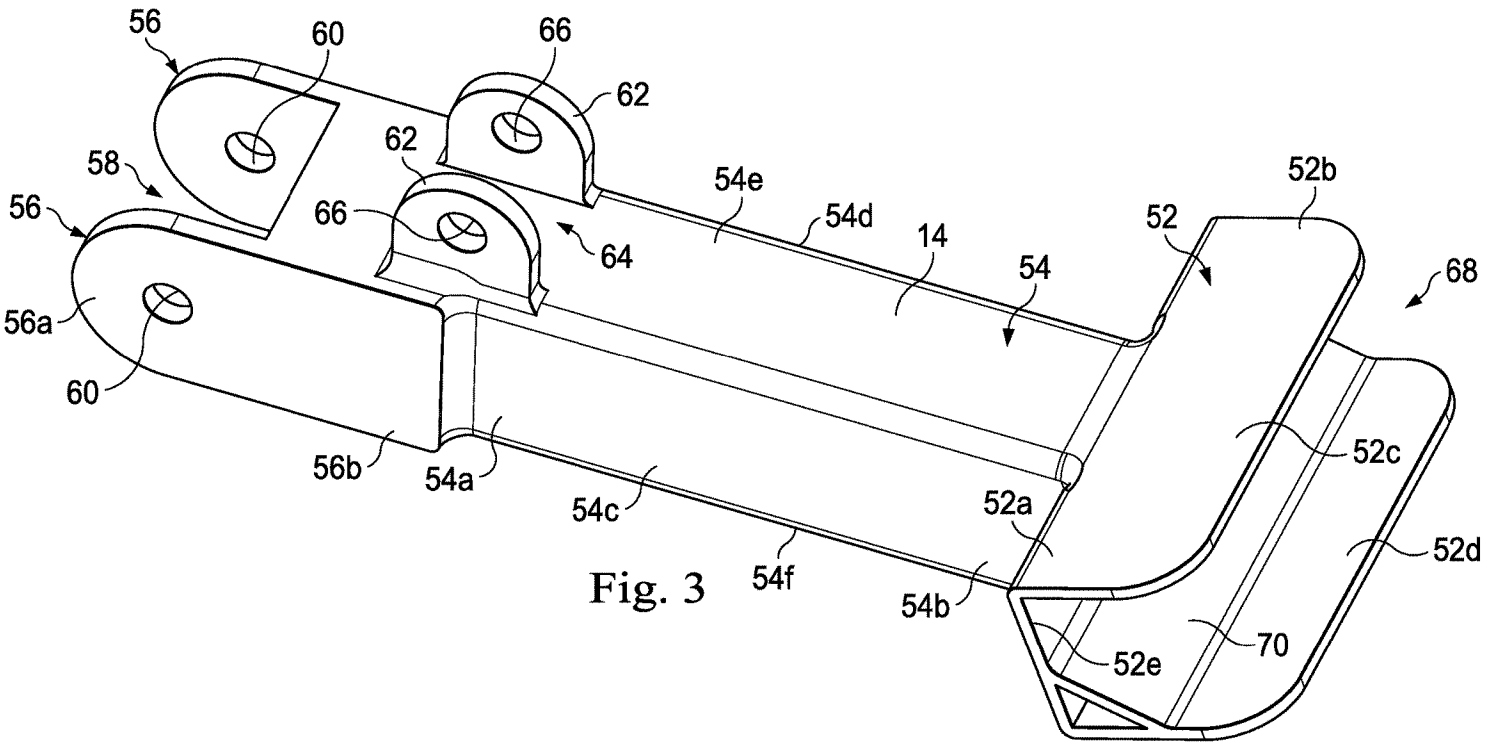
FIG. 3 is a perspective view of the cantilever arm of FIG. 1, according to an exemplary embodiment.

In an exemplary embodiment, as illustrated in FIG. 3 with continuing reference to FIG. 1, the cantilever arm 14 includes a catch member 52 and an elongated member such as, for example, a square tube 54. The square tube 54 includes opposing end portions 54*a* and 54*b*, side portions 54*c* and 54*d*, and top and bottom portions 54*e* and 54*f*, respectively. A pair of pivot arms 56 are connected to the respective side portions 54*c* and 54*d* of the square tube 54 at the end portion 54*a* thereof. The pivot arms 56 are spaced in a parallel, or substantially parallel, relation, each defining opposing end portions 56*a* and 56*b*. The end portion 56*b* of each pivot arm is connected to the end portion 54*a* of the square tube 54. Further, the end portion 56*a* of each pivot arm 56 extends longitudinally beyond the periphery of the end portion 54*a* of the square tube 54. A gap 58 is defined between the respective end portions 56*a* of the pivot arms 56. An opening 60 is formed through each of the pivot arms 56 at the end portion 56*a* thereof. Further, the pivot arms 56 are oriented in relation to one another such that the respective openings 60 thereof are substantially aligned. The gap 58 is adapted to receive the end portion 26*b* of the square tube 26, such that the openings 60 formed through the pivot arms 56 are substantially aligned with the opening 32 formed through the square tube 26. From this position, the cantilever arm 14 is adapted to pivot about the base member 12. A pair of latch arms 62 are connected to the top portion 54*c* of the square tube 54. The latch arms 72 are spaced in a parallel, or substantially parallel, relation. Moreover, the latch arms 62 extend parallel, or substantially parallel, to the side portions 54*c* and 54*d* of the square tube 54. In addition to, or instead of, being connected to the top portion 54*e* of the square tube 54, the latch arms 62 may be connected to the respective side portions 54*c* and 54*d* of the square tube 54. A gap 64 is defined between the latch arms 62. The gap 64 is adapted to receive the latch 18, as will be discussed in further detail below. An opening 66 is formed through each of the latch arms 62. Further, the latch arms 62 are oriented in relation to one another such that the respective openings 66 thereof are substantially aligned.

The catch member 52 includes opposing end portions 52*a* and 52*b*, side portions 52*c* and 52*d*, and a bottom portion 52*e*. The end portion 54*b* of the square tube 54 is connected to the catch member 52, between the end portions 52*a* and 52*b* thereof. The catch member 52 extends perpendicular, or substantially perpendicular, to the square tube 54 and beyond the periphery of the respective side portions 54*c* and 54*d* thereof. The side portions 52*c* and 52*d* extend in a parallel, or substantially parallel, relation. Further, the side portions 52*c* and 52*d* of the catch member 52 extend perpendicular, or substantially perpendicular, to the bottom portion 52*e* thereof. As a result, the side portions 52*c* and 52*d*, along with the bottom portion 52*e*, define a channel 68 extending along the catch member 52, from the end portion 52*a* to the end portion 52*b* thereof. The channel 68 is adapted to receive a waste container, as will be discussed in further detail below. In several exemplary embodiments, a distal end portion of the side portion 52*d* extends relatively farther from the bottom portion 52*e* than a distal end portion of the side portion 52*c*. In several exemplary embodiments, a ramp 70 is connected between the side portion 52*d* and the bottom portion 52*e* of the catch member 52, and extends along the length thereof.

Figure 4:
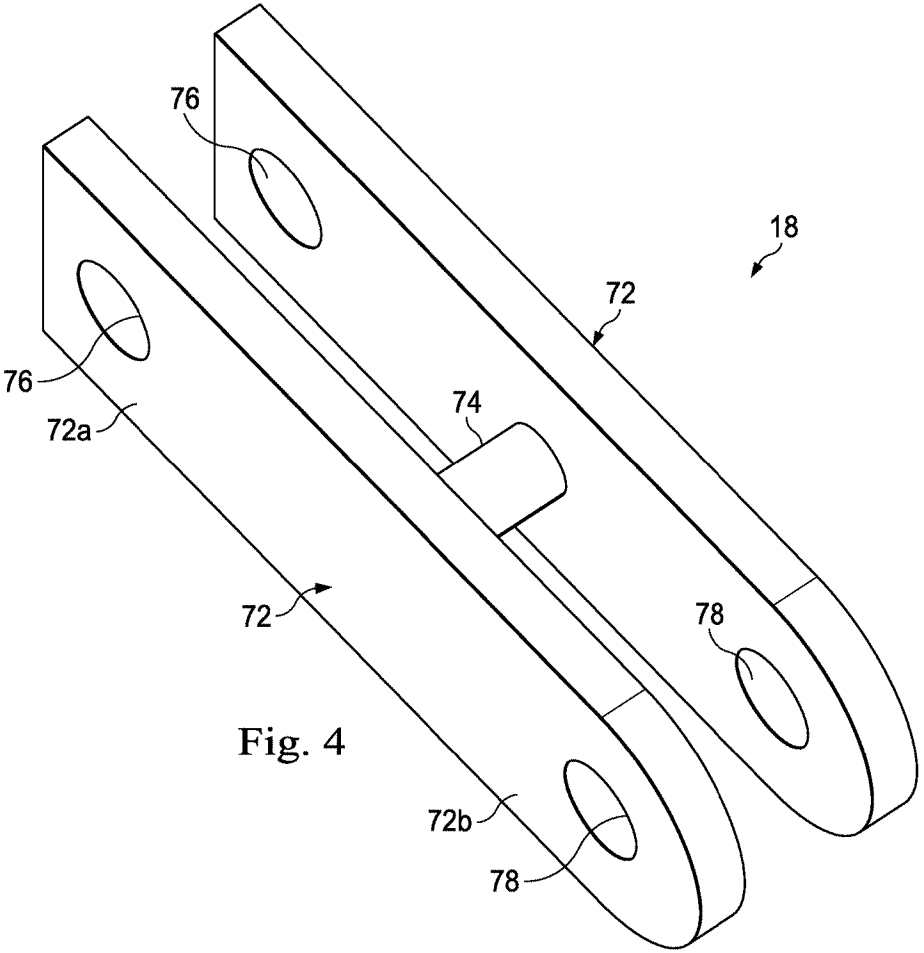
FIG. 4 is a perspective view of the latch of FIG. 1, according to an exemplary embodiment.

In an exemplary embodiment, as illustrated in FIG. 4 with continuing reference to FIG. 1, the latch 18 includes a pair of elongated latch plates 72 spaced in a parallel, or substantially parallel, relation. The latch plates 72 each define opposing end portions 72*a* and 72*b*. The latch plates 72 are interconnected via a support post 74, which is connected to the latch plates 72 at a location between the respective end portions 72*a* and 72*b* thereof. In several exemplary embodiments, the respective end portions 72*a* of the latch plates 72 are flat. In several exemplary embodiments, the respective end portions 72*b* of the latch plate 72 are rounded. An opening 76 is formed through each of the latch plates 72 at the end portion 72*a* thereof. Further, an opening 78 is formed through each of the latch plates 72 at the end portion 72*b* thereof. The latch plates 72 are oriented in relation to one another such that the respective openings 76 and 78 thereof are substantially aligned. The respective end portions 72*a* of the latch plates 72 are adapted to be received between the guide plates 36 of the latch housing 16, such that the openings 76 of the latch plates 72 are substantially aligned with the slots 40 and/or the notches 42 of the guide plates 36. Further, the respective end portions 72*b* of the latch plates 72 are adapted to be received within the gap 64 between the latch arms 62, such that the openings 78 of the latch plates 72 are substantially aligned with the openings 66 of the latch arms 62.

Figure 5:
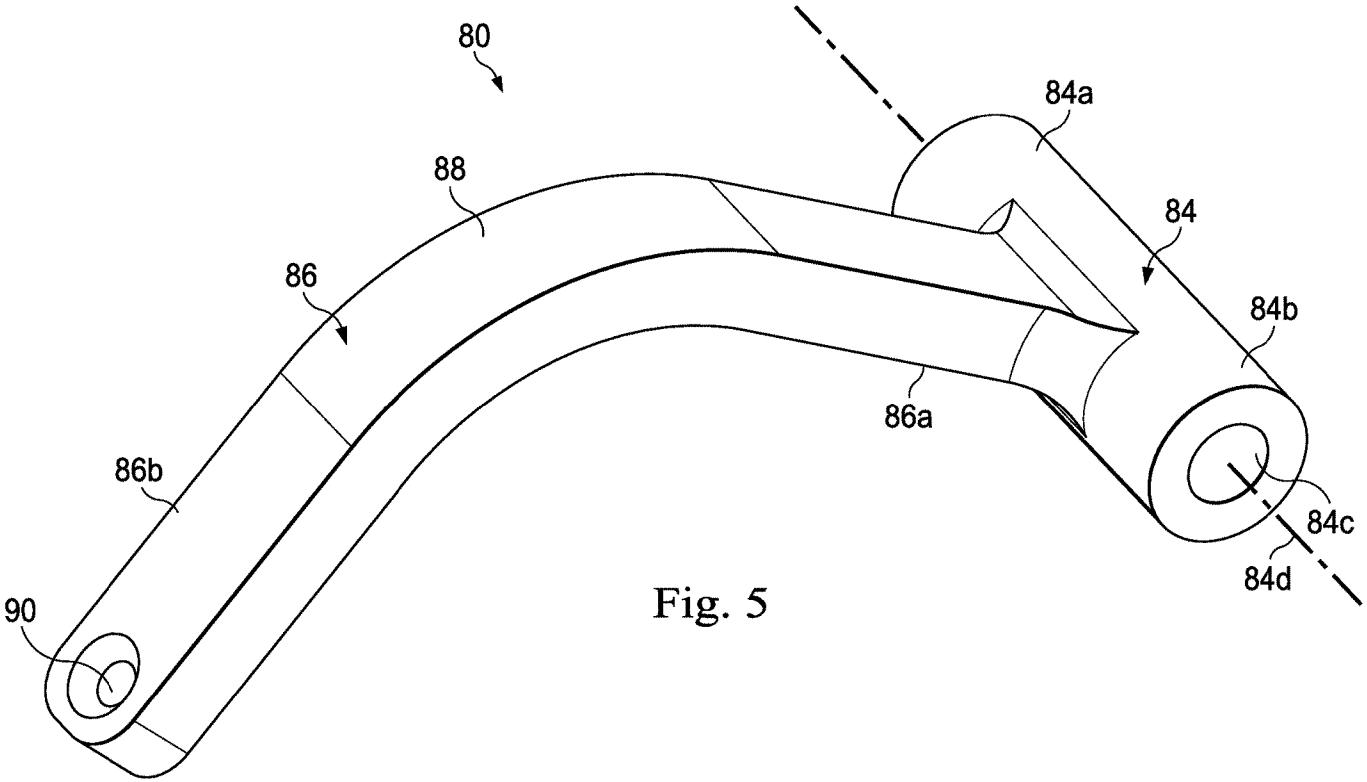
FIG. 5 is a perspective view of a spring arm, which forms a portion of the actuating mechanism of FIG. 1, according to an exemplary embodiment.
Figure 6:
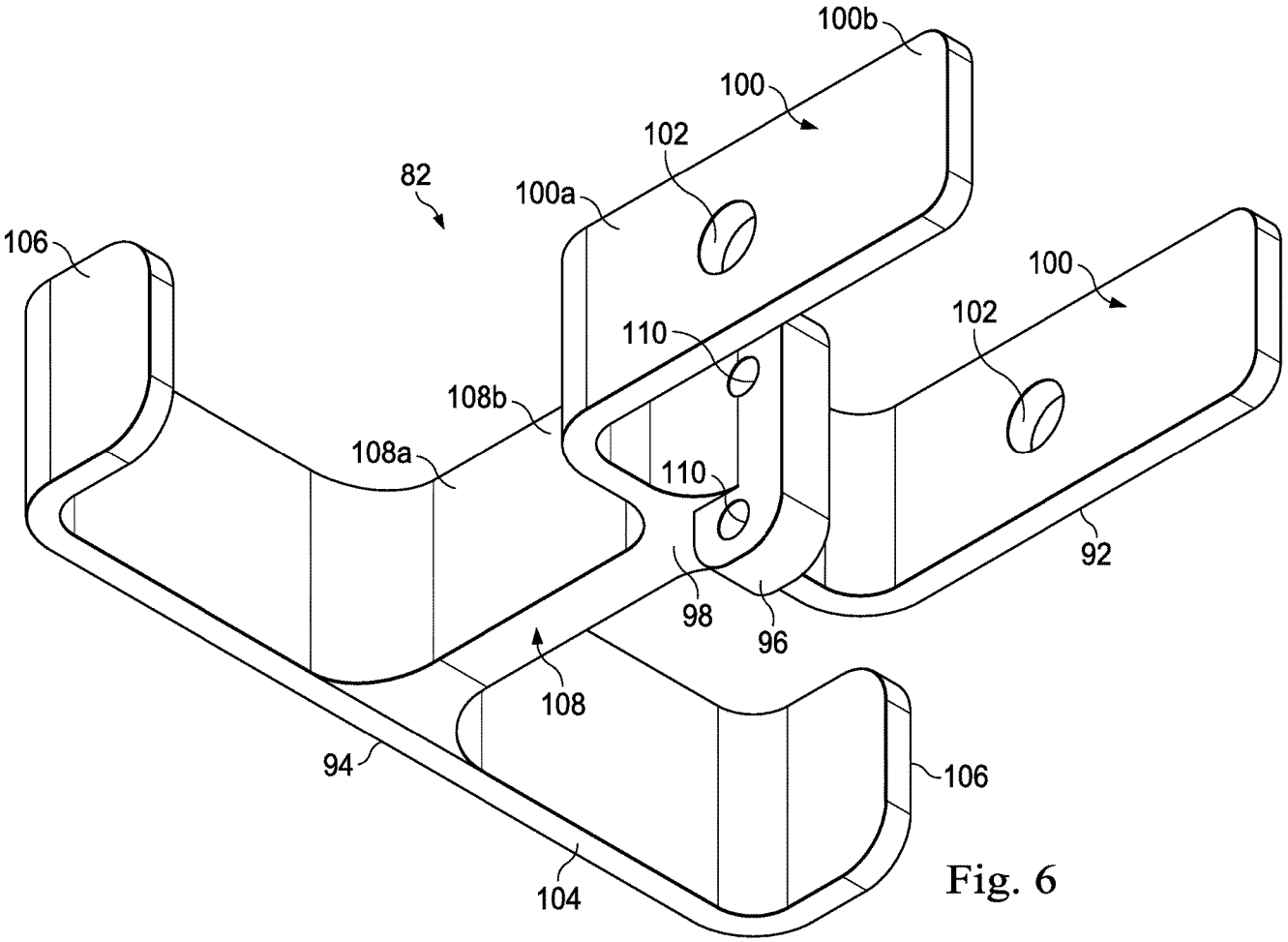
FIG. 6 is a perspective view of an actuating lever, which forms another portion of the actuating mechanism of FIG. 1, according to an exemplary embodiment.

In an exemplary embodiment, as illustrated in FIGS. 5 and 6 with continuing reference to FIG. 1, the actuating mechanism 22 includes a spring arm 80 and an actuating lever 82. As shown in FIG. 5, the spring arm 80 includes a barrel 84 and an elongated cam 86. The barrel 84 is a generally cylindrical tube defining opposing end portions 84*a* and 84*b*, and an internal passage 84*c* extending along a longitudinal axis 84*d*. The elongated cam 86 defines opposing end portions 86*a* and 86*b*. Further, the elongated cam 86 is curved from the end portion 86*a* to the end portion 86*b*, thereby defining a cam profile 88. The curve of the cam profile 88 lies in a plane that is perpendicular, or substantially perpendicular, to the longitudinal axis 84*d* of the barrel 84. The end portion 86*a* of the elongated cam 86 is connected to the barrel 84, between the end portions 84*a* and 84*b* thereof. Further, an opening 90 is formed through the end portion 86*b* of the elongated cam 86. The spring arm 80 is adapted to be received between the guide plates 36 of the latch housing 16, such that the internal passage 84*c* of the barrel 84 is substantially aligned with the openings 46 of the guide plates 36. From this position, the spring arm 80 is adapted to urge the latch 18 to the unlatched configuration, as will be discussed in further detail below.

As shown in FIG. 6, the actuating lever 82 includes a pivot member 92, a handle 94, and a spring hook 96. The pivot member 92 is a generally U-shaped flat bar bent so as to define a laterally extending base portion 98 and a pair of longitudinally extending forks 100. The forks 100 each define a proximal end portion 100*a* and a distal end portion 100*b*. Further, the forks 100 extend in a parallel, or substantially parallel, relation and perpendicular, or substantially perpendicular, to the base portion 98. An opening 102 is formed through each of the forks 100, between the respective proximal and distal end portions 100*a* and 100*b* thereof. The forks 100 are oriented in relation to one another such that the respective openings 102 thereof are substantially aligned. The handle 94 is a generally U-shaped flat bar bent to define a laterally extending grip portion 104 and a pair of longitudinally extending grip stays 106. The grip stays 106 extend in a parallel, or substantially parallel, relation and perpendicular, or substantially perpendicular, to the grip portion 104. The handle 94 further includes a connecting bar 108 that defines opposing end portions 108*a* and 108*b*. The end portion 108*a* of the connecting bar 108 is connected in a perpendicular, or substantially perpendicular, relation to the grip portion 106 of the handle 94. The end portion 108*b* of the connecting bar 108 is connected in a perpendicular, or substantially perpendicular, relation to the base portion 98 of the pivot member 92. The spring hook 96 is connected to the base portion 98, opposite the connecting bar 108, and extends downwardly therefrom, beyond the periphery of the pivot member 92. The spring hook 96 includes one or more openings 110 formed therethrough. The actuating lever 82 is adapted to be at least partially received between the guide plates 36 of the latch housing 16, such that the openings 102 of the forks 100 are substantially aligned with the openings 48 of the guide plates 36. From this position, the actuating lever 82 is adapted to actuate the spring arm 80, via the spring hook 96, as will be discussed in further detail below.

Figure 7:
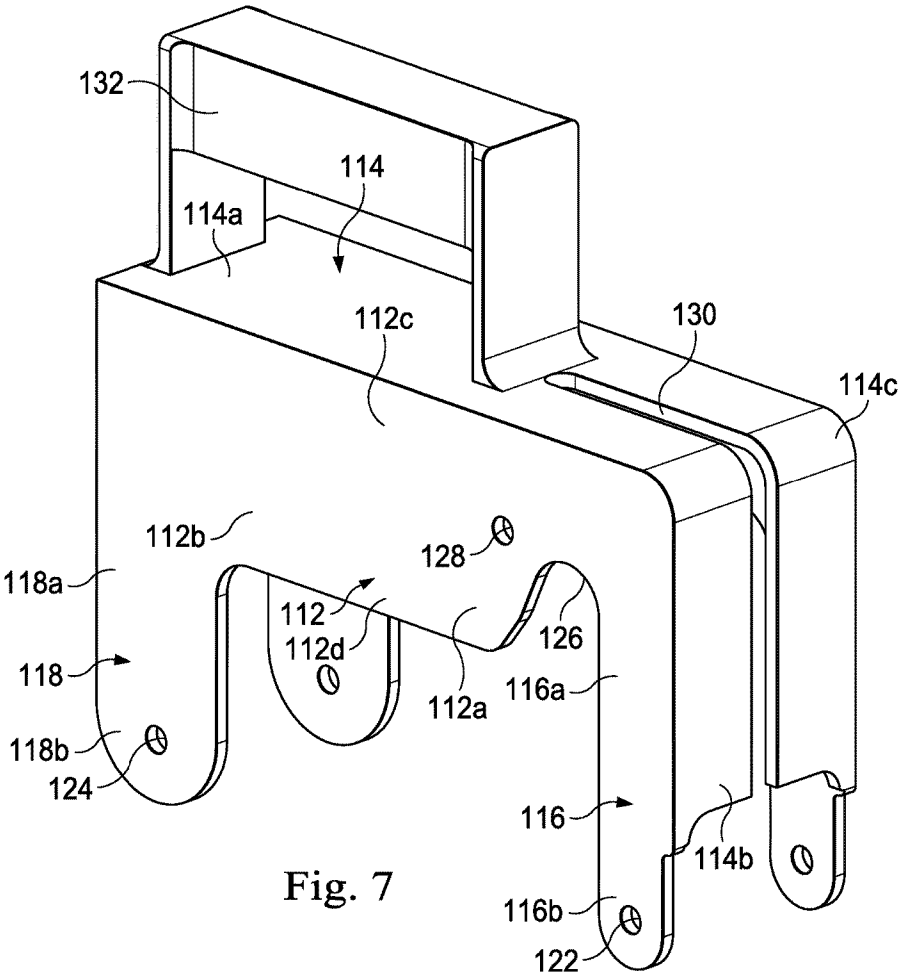
FIG. 7 is a perspective view of the shield of FIG. 1, according to an exemplary embodiment.

In an exemplary embodiment, as illustrated in FIG. 7 with continuing reference to FIG. 1, the shield 24 includes a pair of side plates 112 spaced in a parallel, or substantially parallel, relation and interconnected by a cover plate 114. Each of the side plates 112 defines a front edge portion 112*a*, a rear edge portion 112*b*, a top edge portion 112*c*, and a bottom edge portion 112*d*. A pair of support legs 116 and 118 extend downwardly from the respective front and rear edge portions 112*a* and 112*b* of each side plate 112, beyond the periphery of the bottom edge portion 112*d* thereof. The support leg 116 defines a proximal end portion 116*a* and a distal end portion 116*b*. An opening 122 is formed through the support leg 116 at the distal end portion 116*b* thereof. Moreover, the support leg 118 defines a proximal end portion 118*a* and a distal end portion 118*b*. An opening 124 is formed through the support leg 118 at the distal end portion 118*b* thereof. The bottom edge portion 112*d* of each side plate 112 extends horizontally between the proximal end portion 118*a* of the support leg 118 and a location adjacent the proximal end portion 116*a* of the support leg 116. However, the bottom edge portion 112*d* slopes upwardly proximate the support leg 116, thereby defining a recess 126. An opening 128 is formed through each of the side plates 112 between the recess 126 and the rear edge portion 112*b* thereof, at a position adjacent and above the recess 126. The side plates 112 are oriented in relation to one another such that the recesses 126 and the respective openings 122, 124, and 128 thereof are substantially aligned. The cover plate 114 is connected to, and extends along, the respective support legs 116, front edge portions 112*a*, and top edge portions 112*c* of the side plates 112. Moreover, the cover plate 114 defines an end portion 114*a* proximate the respective rear edge portions 112*b* of the side plates 112, an end portion 114*b* proximate the respective distal end portions 118*b* of the support legs 116, and a bend 114*c* proximate the junction of the respective front edge portions 112*a* and top edge portions 112*c* of the side plates 112. A gap 130 extends along a length of the cover plate 114, beginning at the end portion 114*b* and extending beyond the bend 114*c*. The gap 130 is adapted to accommodate the connecting bar 108 of the handle 94. Finally, in several exemplary embodiments, a carry handle 132 is also connected to the cover plate 114, between the gap 130 and the end portion 114*a*. The shield 24 is adapted to be positioned such that the respective openings 122 and 124 in the support legs 116 and 118 are substantially aligned with the respective openings 34 of the square tube 26. In this position, the shield 24 is adapted to cover respective portions of the latch housing 16, the latch 18, and the actuating mechanism 22.

Figure 8A:
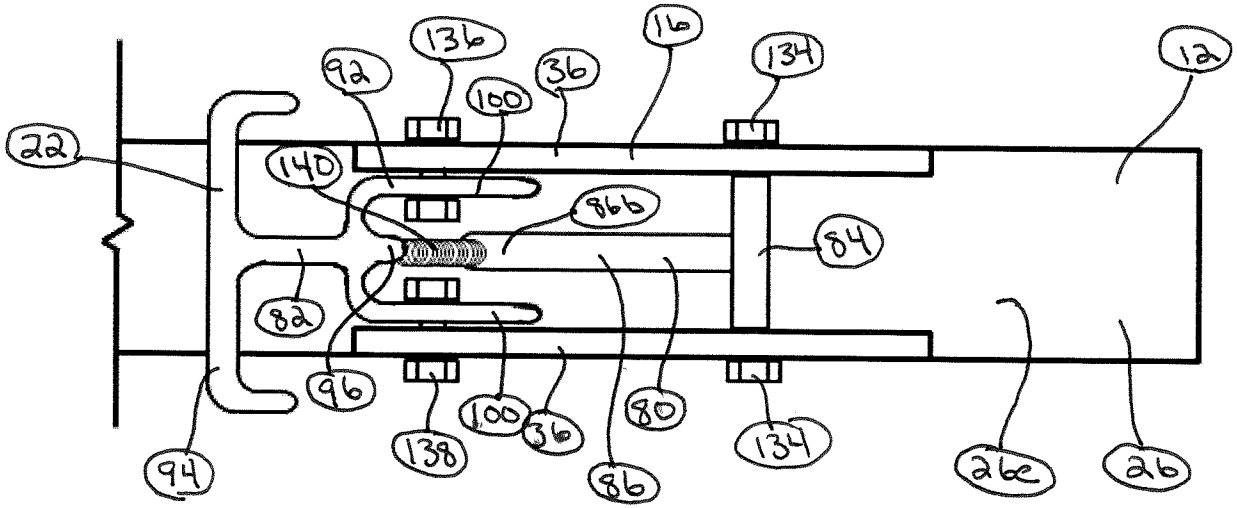
FIG. 8A is a top plan view of the base member and the latch housing of FIG. 2 assembled with the actuating mechanism of FIGS. 5 and 6, according to an exemplary embodiment.

Referring to FIG. 8A, the base member 12 and the latch housing 16 are illustrated in an assembled state with the actuating mechanism 22. More particularly, the spring arm 80 is connected between the guide plates 36 of the latch housing 16, via a threaded connector 134 that extends through the internal passage 84*c* of the barrel 84 and the openings 46 of the guide plates 36. The spring arm 80 is oriented such that the end portion 86*b* of the elongated cam 86 is permitted to contact the top portion 26*e* of the square tube 26. Moreover, the pivot member 92 of the actuating lever 82 is connected between the guide plates 36 of the latch housing 16, via threaded connectors 136 and 138. Specifically, the threaded connector 136 extends through the opening 48 in one of the guide plates 36 and the opening 102 in one of the forks 100, while the threaded connector 138 extends through the opening 48 in the other of the guide plates 36 and the opening 102 in the other of the forks 100. Assembled as such, the handle 94 and the spring hook 96 are permitted to rotate about the threaded connectors 136 and 138 connected to the pivot member 92. A spring 140 is coupled between a selected one of the openings 110 in the spring hook 96 and the opening 90 in the end portion 86*b* of the elongated cam 86. In several exemplary embodiments, the tension in the spring 140 is adjusted be changing the opening 110 to which the spring 140 is coupled.

Figure 8B:
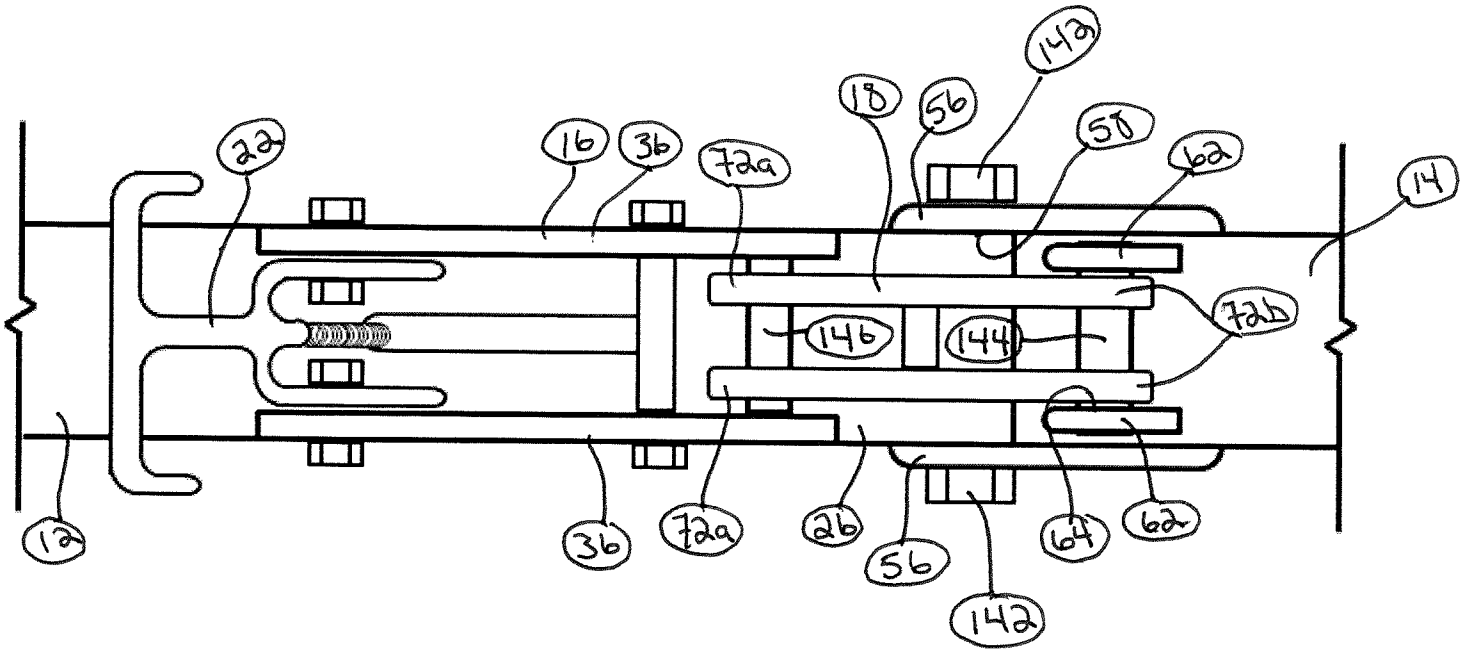
FIG. 8B is a top plan view of the cantilever arm of FIG. 3 and the latch of FIG. 4 assembled with the base member and the latch housing of FIG. 2 and the actuating mechanism of FIGS. 5 and 6, according to an exemplary embodiment.

Referring now to FIG. 8B, the cantilever arm 14 and the latch 18 are illustrated in an assembled state with the base member 12, the latch housing 16, and the actuating mechanism 22. More particularly, the square tube 26 of the base member 12 is connected within the gap 58, between the respective pivot arms 56 of the cantilever arm 14, via a threaded connector 142 that extends through the openings 60 in the pivot arms 56 and the opening 32 in the square tube 26. Further, the respective end portions 72*b* of the latch plates 72 are connected within the gap 64, between the respective latch arms 62 of the cantilever arm 14, via a pin 144 that extends through the openings 78 of the latch plates 72 and the openings 66 of the latch arms 62. Further still, the respective end portions 72*a* of the latch plates 72 are connected between the guide plates 36 of the latch housing 16, via a sliding pin 146 that extends through the openings 76 of the latch plates 72 and the slots 40 and/or the notches 42 of the guide plates 36. Assembled as such, the cantilever arm 14 is permitted to pivot about the base member 12. Moreover, the latch 18, which includes the latch plates 72, is permitted to rotate relative to the cantilever arm 14 while sliding within the slots 40 and relative to the guide plates 36.

Figure 8C:
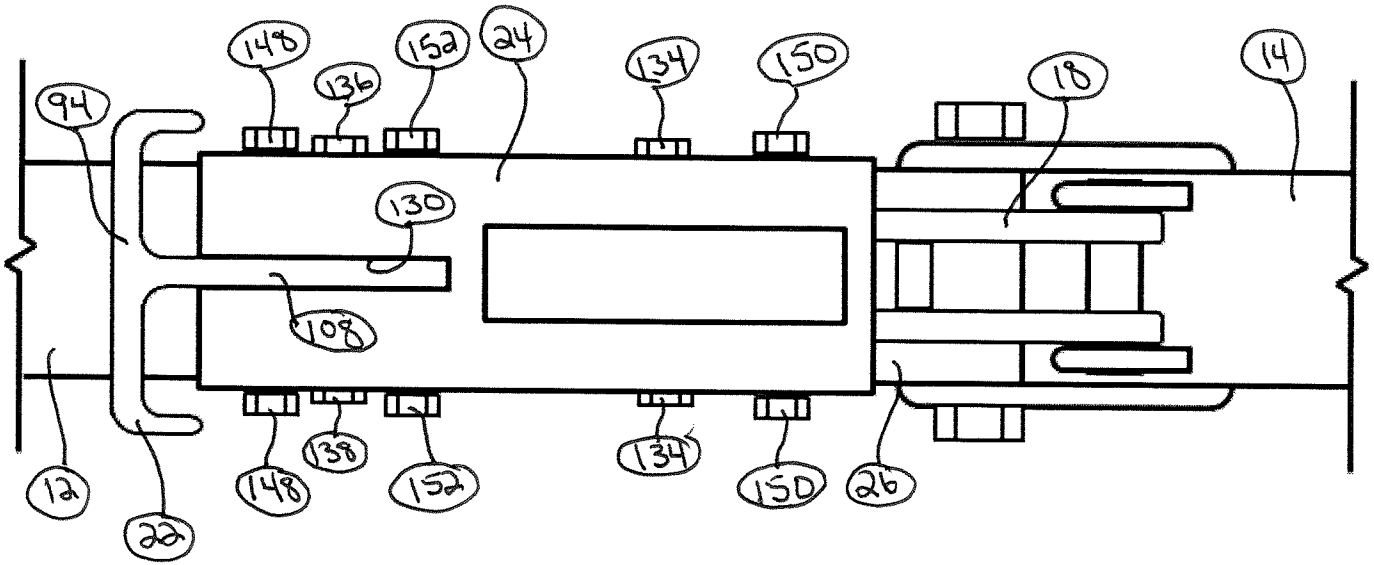
FIG. 8C is a top plan view of the shield of FIG. 7 assembled with the base member and the latch housing of FIG. 2, the cantilever arm of FIG. 3, the latch of FIG. 4, and the actuating mechanism of FIGS. 5 and 6, according to an exemplary embodiment.

Referring additionally to FIG. 8C, the shield 24 is illustrated in an assembled state with the base member 12, the cantilever arm 14, the latch housing 16, the latch 18, and the actuating mechanism 22. More particularly, the shield 24 is connected to the square tube 26 of the base member 12, via a pair of threaded connectors 148 and 150. The threaded connector 148 extends through the openings 122 in the respective support legs 116 and one of the openings 34 in the square tube 26. The threaded connector 150 extends through the openings 124 in the respective support legs 118 and the other of the openings 34 in the square tube 26. Moreover, the shield 24 is connected to the guide plates 36 of the latch housing 16, via a threaded pivot stay 152 that extends through the openings 50 in the guide plates 36 and the openings 128 in the side plates 112 of the shield 24. Assembled as such, the shield 24 covers respective portions of the latch housing 16, the latch 18, and the actuating mechanism 22. The gap 130 formed in the shield 24 accommodates the connecting bar 108 of the handle 94, such that the handle 94 and the spring hook 96 of the actuating lever 82 are permitted to rotate about the threaded connectors 136 and 138 connected to the pivot member 92. Further, the distal end portions 100*b* of the forks 100 of the pivot member 92 are adapted to abut the threaded pivot stay 152, thereby limiting downward motion of the handle 94 relative to the base member 12.

Figure 9A:
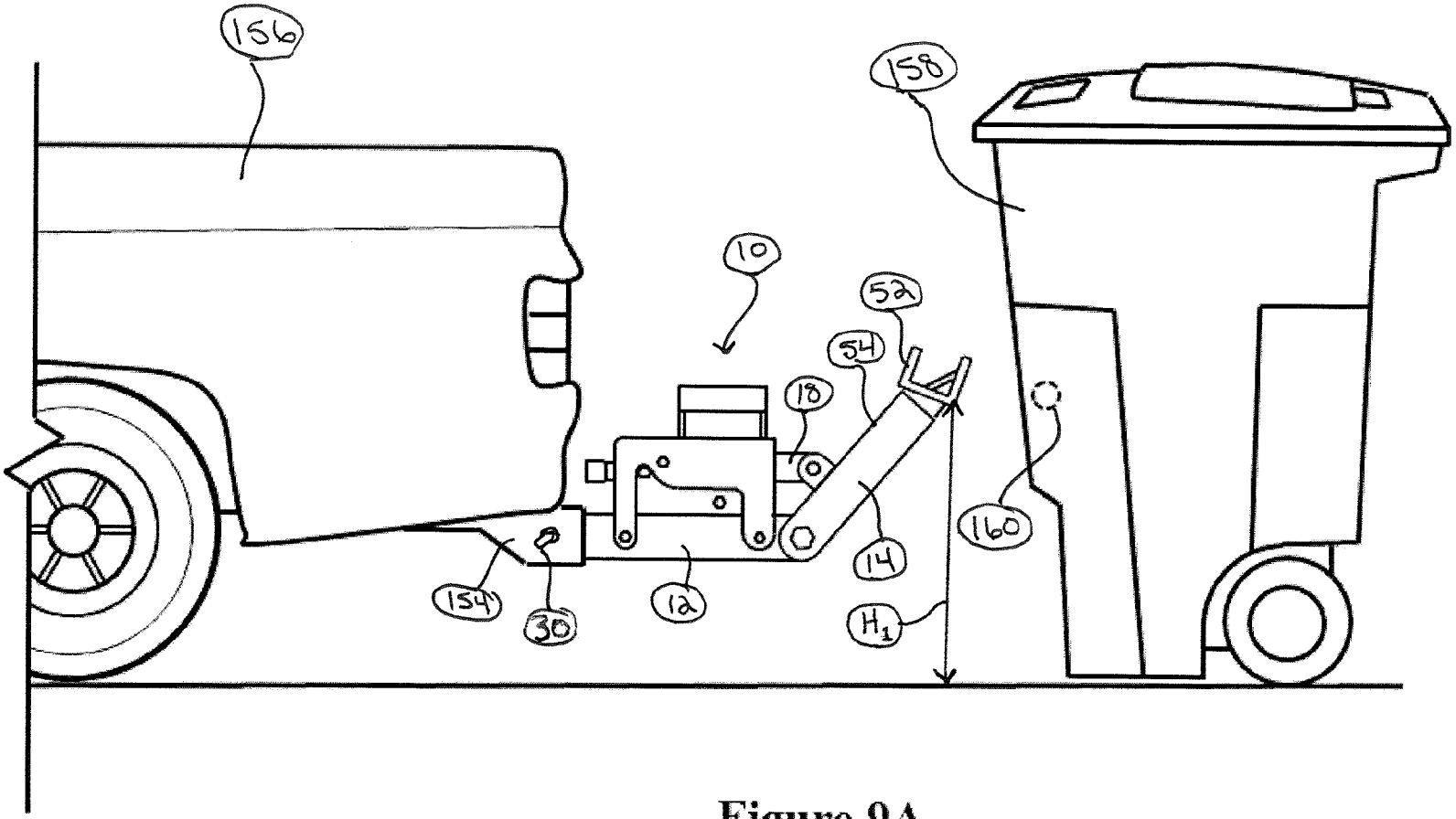
FIG. 9A is a diagrammatic view of a waste container and a transport vehicle to which the waste container transport device is coupled, with the waste container transport device in a loading configuration, according to an exemplary embodiment.
Figure 9B:
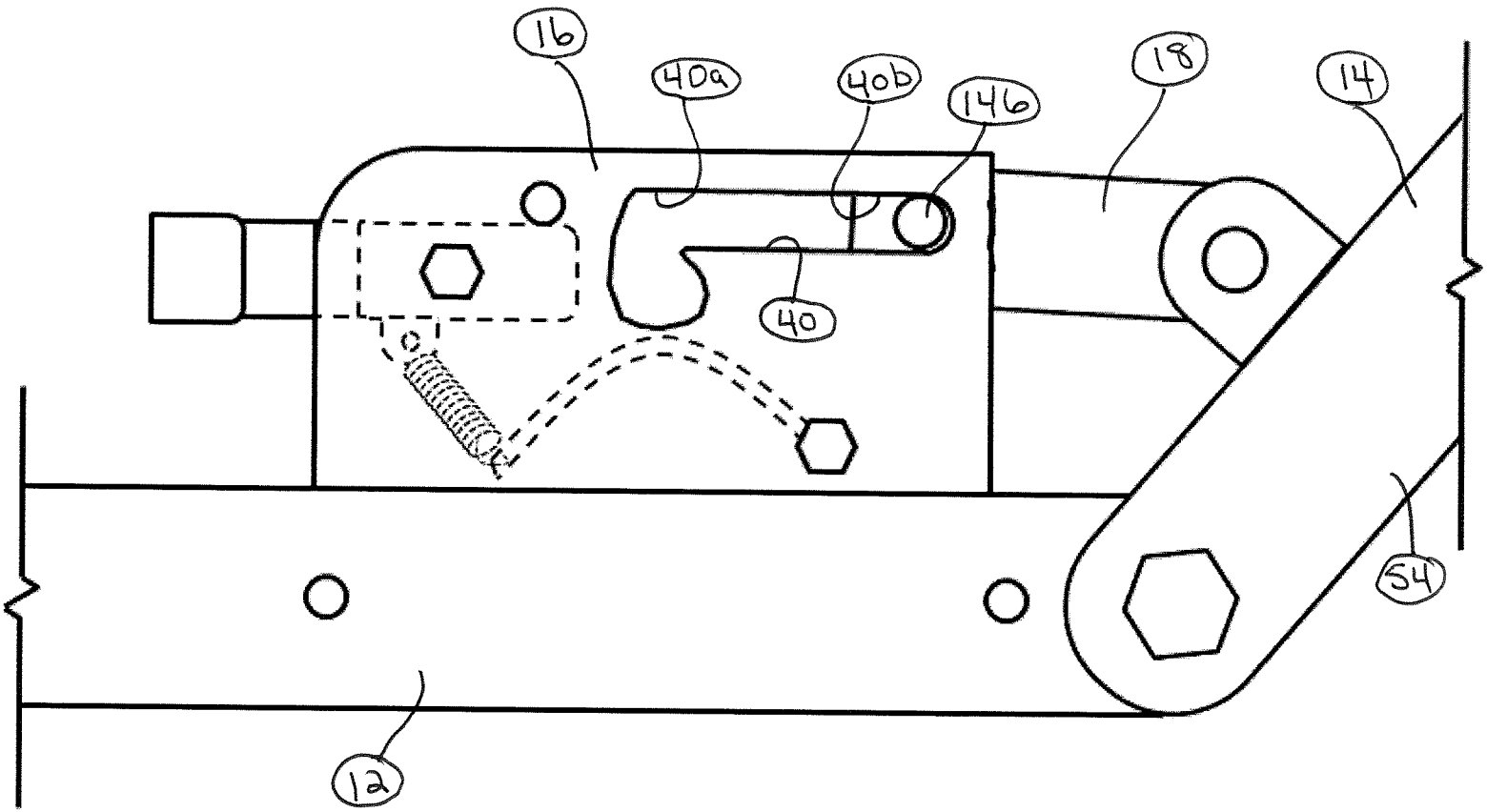
FIG. 9B is a detailed view of the waste container transport device of FIG. 9A, with the latch in an unlatched configuration, according to an exemplary embodiment.
Figure 9C:
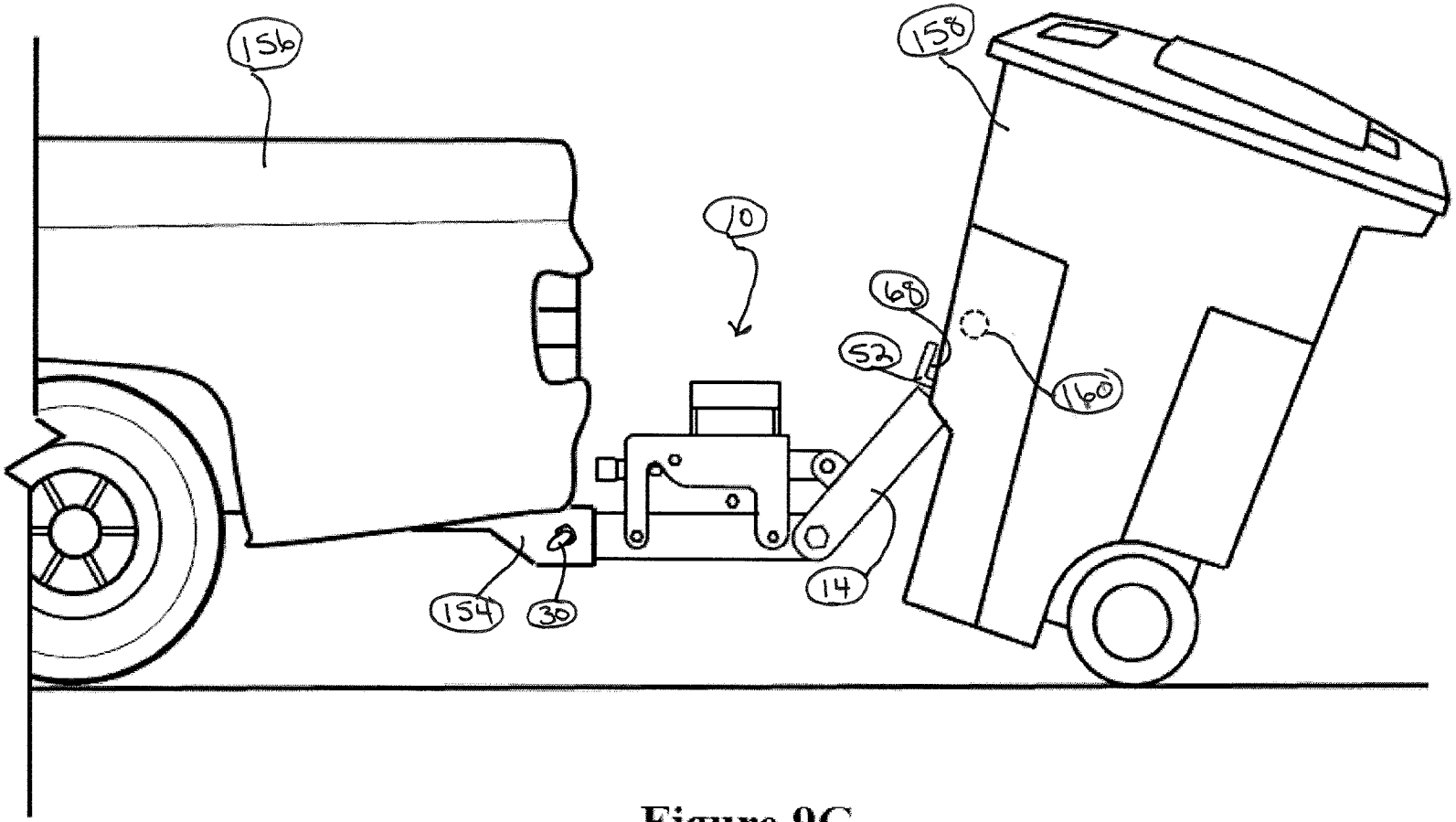
FIG. 9C is a diagrammatic view of the waste container, the transport vehicle, and the waste container transport device of FIG. 9A, with the waste container being loaded onto the waste container transport device, according to an exemplary embodiment.

In operation, according to an exemplary embodiment as illustrated in FIGS. 9A-9C, 10A, 10B, and 11A-11C, the waste container transport device 10 is coupled to a receiver hitch 154 of a transport vehicle 156, via the pin 30. The waste container transport device 10 and the transport vehicle 156 are used to transport a waste container 158, which includes a horizontally-extending catch bar 160. Referring initially to FIGS. 9A and 9B, in order to load the waste container 158 onto the waste container transport device 10, the cantilever arm 14 is first placed in the loading configuration, so that the catch member 52 of the cantilever arm 14 is situated to receive the catch bar 160 of the waste container 158. Specifically, the latch 18 is placed in the unlatched configuration so that the sliding pin 146 is disposed within, and permitted to move longitudinally relative to, the slot 40, between the end portions 40*a* and 40*b* thereof, as shown in FIG. 9B. As a result, the latch 18 is permitted to move longitudinally relative to the latch housing 16. Further, the cantilever arm 14 is permitted to pivot outwardly relative to the base member 12 until the sliding pin 146 abuts the end portion 40*b* of the slot 40. In this position, the square tube 54 of the cantilever arm 14 is angled outwardly relative to the base member 12 so that the catch member 52 is situated at a height $H_1$ off of the ground, as shown in FIG. 9A. When the cantilever arm 14 is placed in the loading configuration as described, the height $H_1$ of the catch member 52 permits the catch bar 160 of the waste container 158 to be placed within the channel 68 of the catch member 52, as shown in FIG. 9C.

Figure 10A:
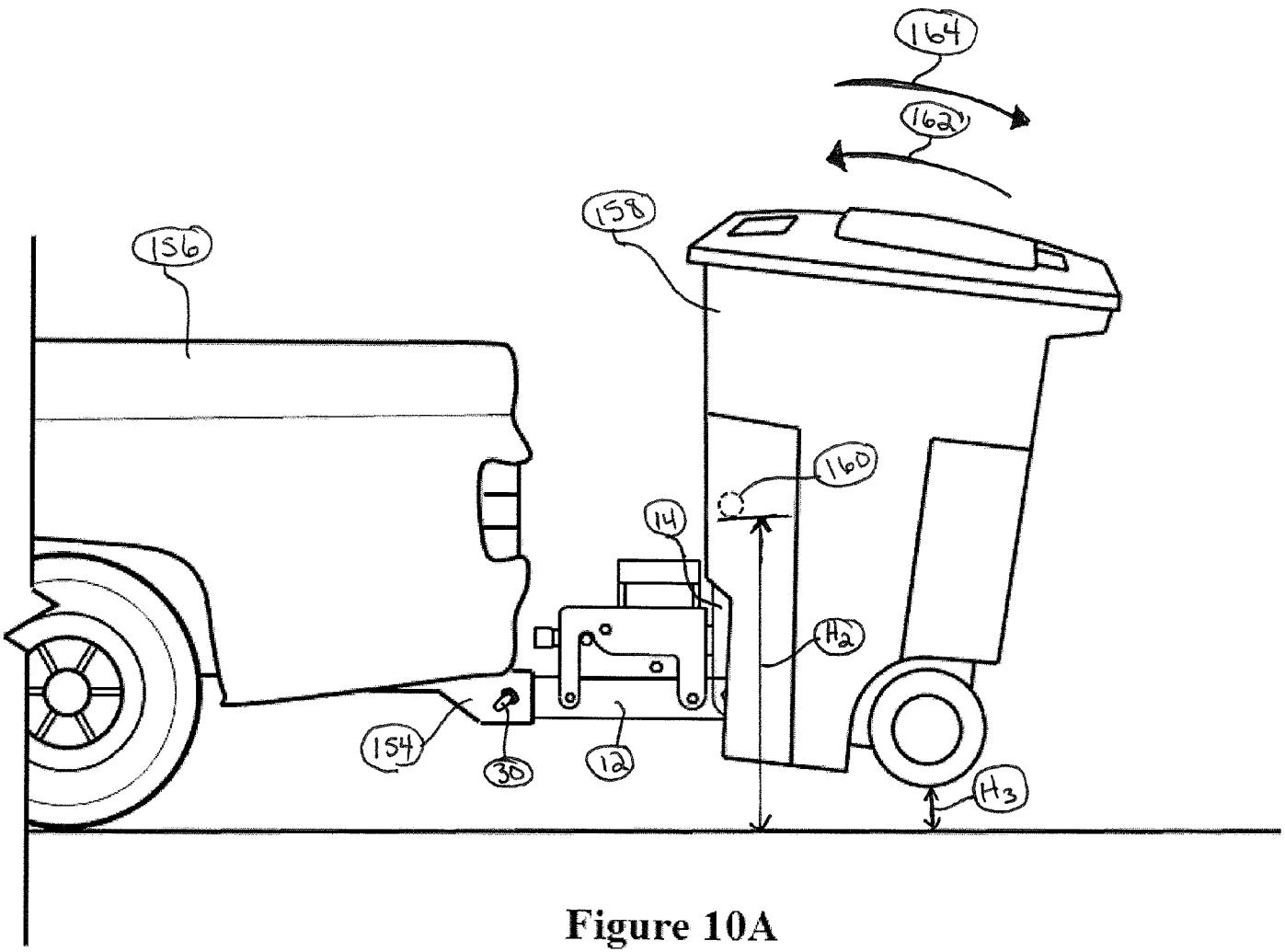
FIG. 10A is a diagrammatic view of the waste container, the transport vehicle, and the waste container transport device, with the waste container transport device in a transporting configuration, according to an exemplary embodiment.
Figure 10B:
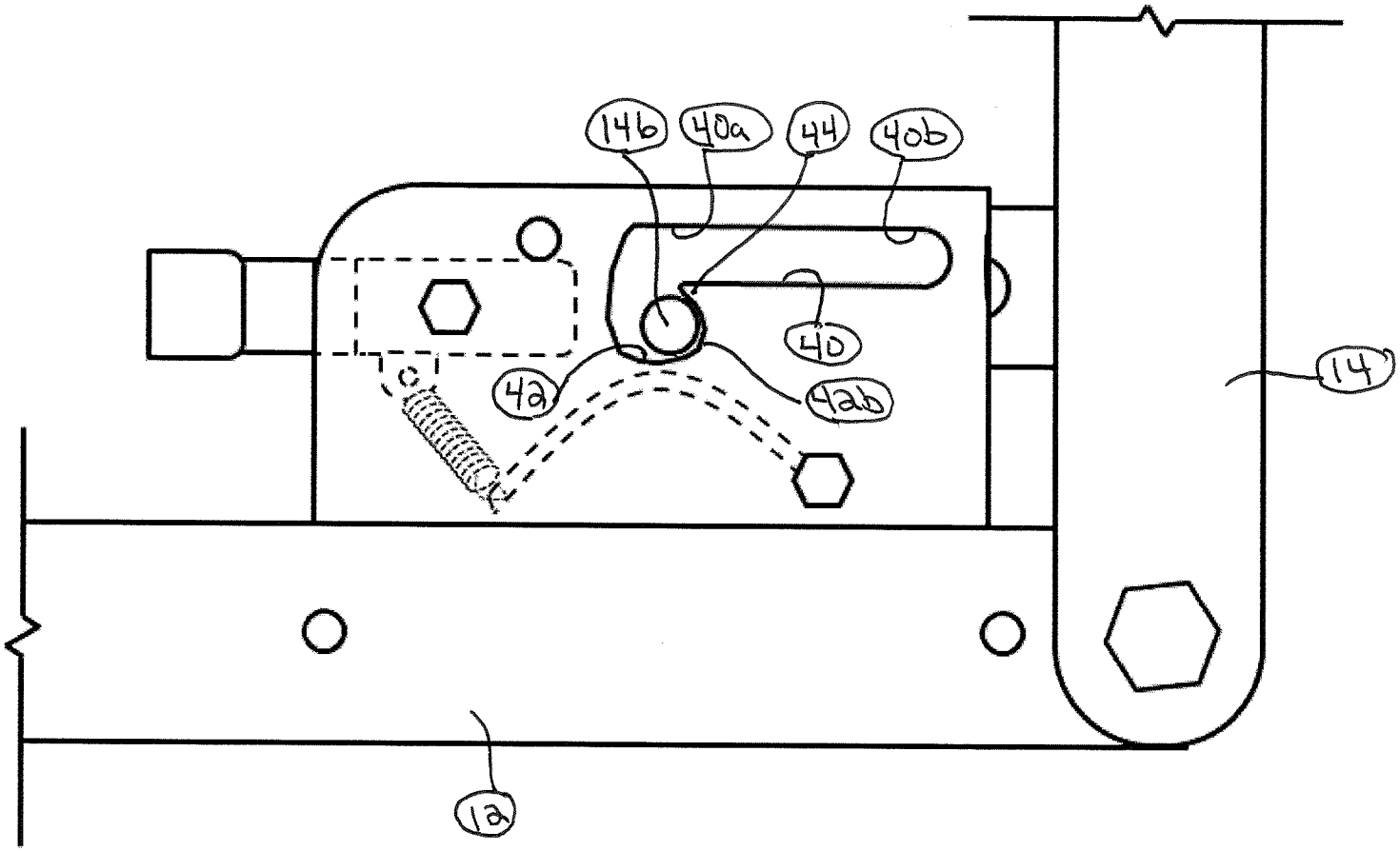
FIG. 10B is a detailed view of the waste container transport device of FIG. 10A, with the latch in a latched configuration, according to an exemplary embodiment.

Referring now to FIGS. 10A and 10B, once the catch bar 160 of the waste container 158 has been placed in the channel 68 of the catch member 52, an external force is applied to the cantilever arm 14 via, for example, the waste container 158, causing the cantilever arm 14 to pivot about the base member 12 in an angular direction 162. As a result, the waste container 158 is lifted off the ground via the catch bar 160 and moved in the angular direction 162. At the same time, the sliding pin 146 moves longitudinally within the slot 40, from the end portion 40*b* toward the end portion 40*a* thereof. Continued application of the external force to the cantilever arm 14 via, for example, the waste container 158, causes the cantilever arm 14 to continue to pivot about the base member 12 in the direction 162 until reaching the transporting configuration, as shown in FIG. 10A. In the transporting configuration, the catch member 52 of the cantilever arm 14 supports the catch bar 160 of the waste container 158 at a height $H_2$ off of the ground, which is greater than the height $H_1$. As a result, the waste container 158 is maintained at a height $H_3$ off of the ground. In order to secure the cantilever arm 14 in the transporting configuration, the latch 18 is placed in the latched configuration. Specifically, as the cantilever arm 14 continues to pivot about the base member 12 in the direction 162, the sliding pin 146 moves longitudinally toward the end portion 40*a* of the slot 40, as shown in FIG. 10B. At the end portion 40*a* of the slot 40, the sliding pin 146 is permitted to fall into the notch 42. Subsequently, the external force is released from the cantilever arm 14 and the weight of the waste container 158 urges the cantilever arm 14 in an angular direction 164, which is opposite the angular direction 162. As a result, the sliding pin 146 is urged into abutment with the end portion 42*b* of the notch 42, adjacent the protrusion 44. After the latch 18 has been placed in the latched configuration as described, thus securing the cantilever arm 14 in the transporting configuration, the transport vehicle 156 may be utilized to transport the waste container 158 to an unloading site.

Figure 11A:
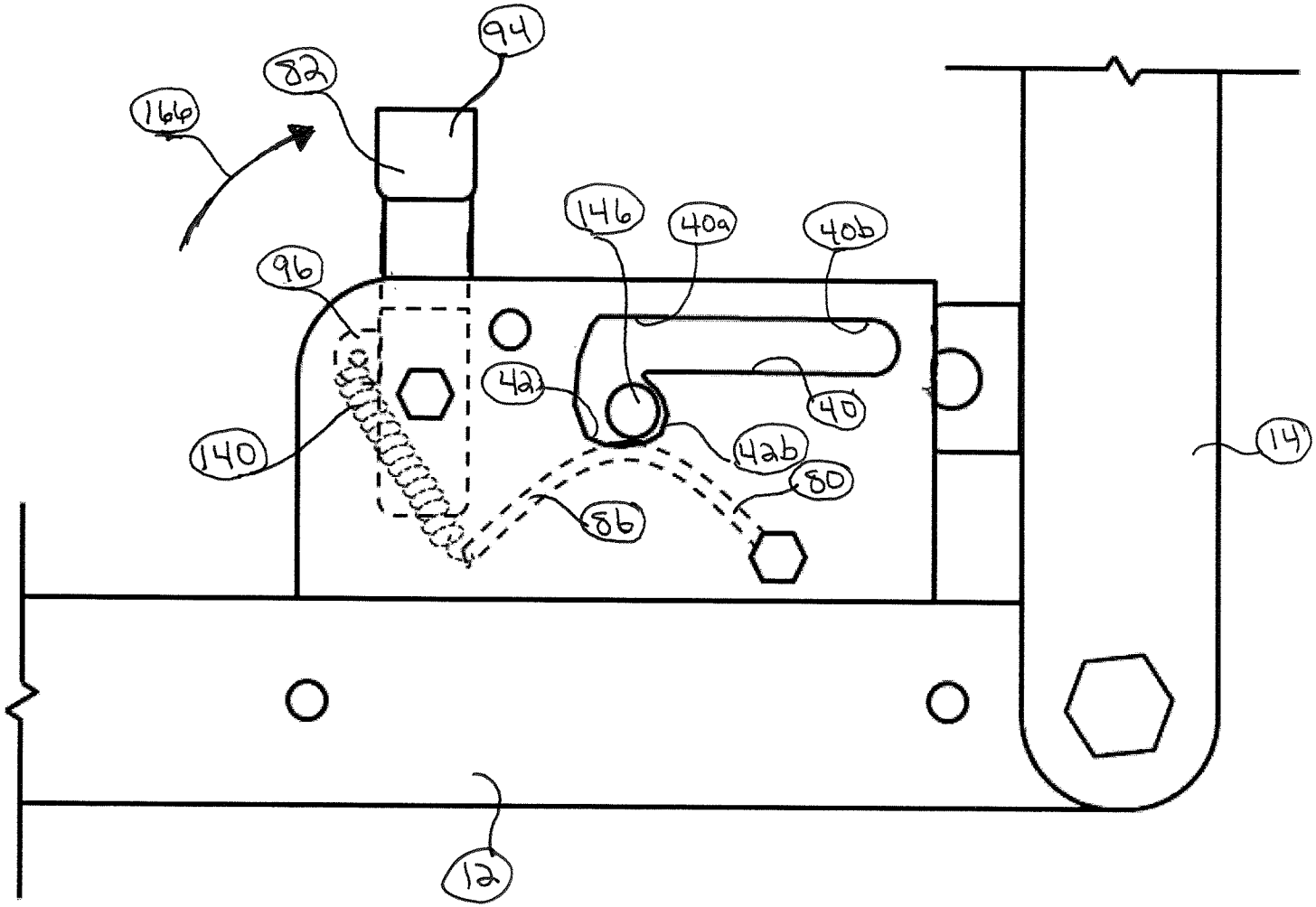
FIG. 11A is a further detailed view of the waste container transport device of FIG. 10A, with the actuating mechanism contacting the latch, according to an exemplary embodiment.
Figure 11B:
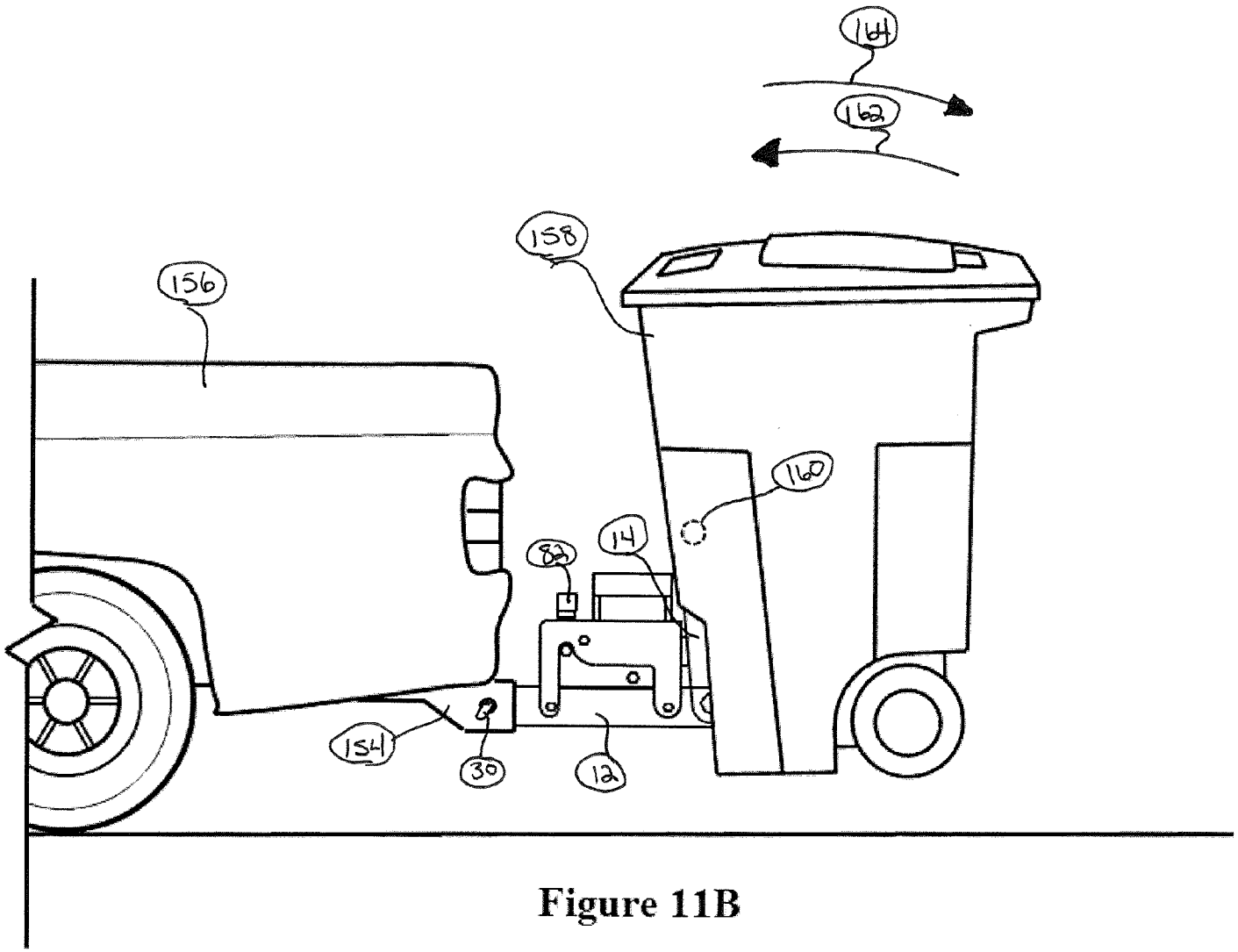
FIG. 11B is a diagrammatic view of the waste container, the transport vehicle, and the waste container transport device, with an external force being applied to the waste container, according to an exemplary embodiment.
Figure 11C:
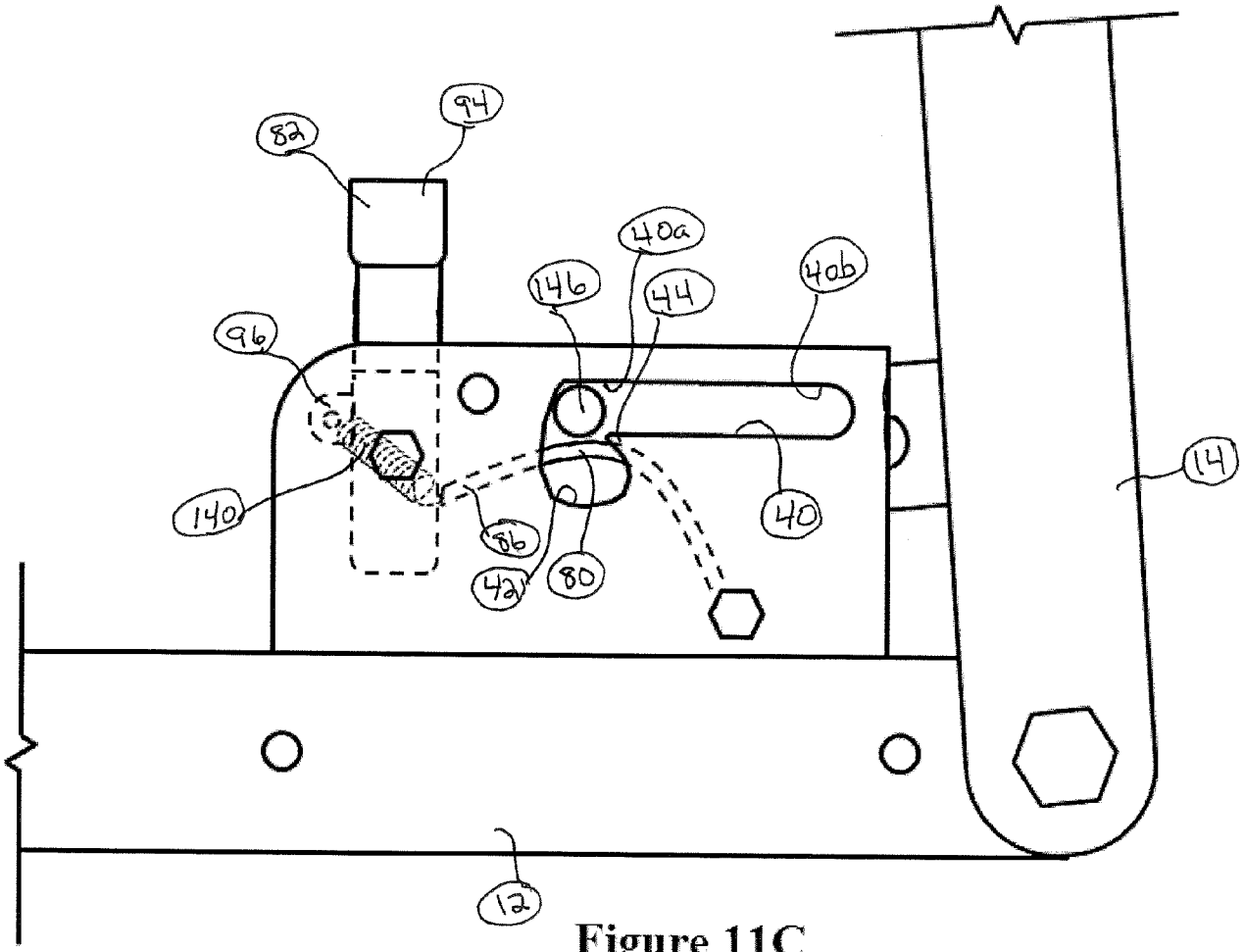
FIG. 11C is a detailed view of the waste container transport device of FIG. 11B, with the actuating mechanism urging the latch from the latched configuration to the unlatched configuration in response to the external force applied to the waste container, according to an exemplary embodiment.

Referring additionally to FIGS. 11A-11C, once the transport vehicle 156 reaches the unloading site, the actuating lever 82 is rotated in an angular direction 166 via the handle 94, thereby causing the spring 140 to be placed in tension between the elongated cam 86 of the spring arm 80 and the spring hook 96 of the actuating lever 82. The tension in the spring 140 urges the elongated cam 86 of the spring arm 80 into contact with the sliding pin 146, as shown in FIG. 11A. However, as long as the weight of the waste container 158 continues to urge the sliding pin 146 into abutment with the end portion 42*b* of the notch 42, the protrusion 44 prevents the sliding pin 146 from being urged into the slot 40 by the spring arm 80. Subsequent application of an external force to the cantilever arm 14 via, for example, the waste container 158, causes the cantilever arm 14 to pivot about the base member 12 in the angular direction 162, as shown in FIG. 11B. As a result, the tension in the spring 140 causes the spring arm 80 to urge the sliding pin 146 into the slot 40, thereby placing the latch 18 in the unlatched configuration, as shown in FIG. 11C. Once the latch 18 is placed in the unlatched configuration, the cantilever arm 14 can be returned to the loading configuration. Specifically, a gradual release of the external force from the cantilever arm 14 via, for example, the waste container 158, permits the weight of the waste container 158 to pivot the cantilever arm 14 about the base member 12 in the direction 164. Further, the sliding pin 146 is permitted to move longitudinally within the slot 40, from the end portion 40*a* toward the end portion 40*b* thereof. Once the waste container 158 reaches the ground, the catch bar 160 of the waste container 158 may be disengaged from the catch member 52 of the cantilever arm 14.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. An apparatus for transporting a waste container, the apparatus comprising:

a base member;

a latch housing connected to the base member;

a cantilever arm hingedly connected to the base member and adapted to be coupled to the waste container, wherein, when the cantilever arm is coupled to the waste container, the cantilever arm is adapted to pivot about the base member between a loading configuration and a transporting configuration; and a latch hingedly connected to the cantilever arm and adapted to slidingly engage the latch housing and pivot about the cantilever arm when the cantilever arm is pivoted about the base member, the latch being actuatable between a latched configuration and an unlatched configuration;

wherein, when the cantilever arm is in the loading configuration, the waste container is adapted to be coupled to the cantilever arm while the waste container is situated on a surface location;

wherein, when the cantilever arm is in the transporting configuration, the waste container is elevated above the surface location by the cantilever arm; and wherein the latch housing comprises:

a guide plate connected to the base member;

a slot formed through the guide plate and defining first and second end portions; and a notch formed through the guide plate at the first end portion of the slot, the notch extending downwardly from the slot.

2. The apparatus as recited in claim 1, further comprising an actuating mechanism connected to the latch housing and adapted to actuate the latch between the latched configuration and the unlatched configuration;

wherein the latch further comprises a sliding pin within at least one of the slot and the notch, and adapted to slidingly engage the guide plate of the latch housing; and wherein the actuating mechanism comprises:

a spring arm connected to the latch housing and adapted to contact the sliding pin of the latch;

an actuating lever connected to the latch housing; and a spring coupled between the actuating lever and the spring arm, wherein the actuating lever is adapted to place the spring in tension.

3. The apparatus as recited in claim 2, wherein, when the spring is placed in tension by the actuating lever, the spring arm is adapted to urge the sliding pin of the latch out of the notch and into the slot, thereby actuating the latch from the latched configuration to the unlatched configuration.

4. An apparatus for transporting a waste container, the apparatus comprising:

a base member;

a latch housing connected to the base member;

a cantilever arm hingedly connected to the base member and adapted to be coupled to the waste container, wherein, when the cantilever arm is coupled to the waste container, the cantilever arm is adapted to pivot about the base member between a loading configuration and a transporting configuration; and a latch hingedly connected to the cantilever arm and adapted to slidingly engage the latch housing when the cantilever arm is pivoted about the base member, the latch being actuatable between a latched configuration and an unlatched configuration;

wherein, when the cantilever arm is in the loading configuration, the waste container is adapted to be coupled to the cantilever arm while the waste container is situated on a surface location;

wherein, when the cantilever arm is in the transporting configuration, the waste container is elevated above the surface location by the cantilever arm;

wherein the latch housing comprises:

a guide plate connected to the base member;

a slot formed through the guide plate and defining first and second end portions; and a notch formed through the guide plate at the first end portion of the slot, the notch extending downwardly from the slot; and wherein the latch comprises:

an elongated latch plate hingedly connected to the cantilever arm; and a sliding pin disposed within at least one of the slot and the notch, and adapted to slidingly engage the guide plate of the latch housing.

5. The apparatus as recited in claim 4, wherein, when the latch is in the unlatched configuration, the sliding pin is disposed within the slot and permitted to slide longitudinally between the first and second end portions thereof, thereby permitting the cantilever arm to rest in the loading configuration; and wherein, when the latch is in the latched configuration, the sliding pin is disposed within the notch, thereby maintaining the cantilever arm in the transporting configuration.

6. The apparatus as recited in claim 5, further comprising an actuating mechanism connected to the latch housing and adapted to actuate the latch between the latched configuration and the unlatched configuration, the actuating mechanism comprising:

a spring arm connected to the latch housing and adapted to contact the sliding pin of the latch;

an actuating lever connected to the latch housing; and a spring coupled between the actuating lever and the spring arm, wherein the actuating lever is adapted to place the spring in tension.

7. The apparatus as recited in claim 6, wherein, when the spring is placed in tension by the actuating lever, the spring arm is adapted to urge the sliding pin of the latch out of the notch and into the slot, thereby actuating the latch from the latched configuration to the unlatched configuration.

8. The apparatus as recited in claim 7, wherein the latch housing further comprises a protrusion formed on the guide plate between the slot and the notch, the protrusion being adapted to prevent, or at least obstruct, the sliding pin of the latch from being urged out of the notch and into the slot by the spring arm of the actuating member.

9. A kit for transporting a waste container, the kit comprising:

a base member;

a latch housing adapted to be connected to the base member;

a cantilever arm adapted to be hingedly connected to the base member and adapted to be coupled to the waste container, wherein, when the cantilever arm is coupled to the waste container, the cantilever arm is adapted to pivot about the base member between a loading configuration and a transporting configuration; and a latch adapted to be hingedly connected to the cantilever arm and adapted to slidingly engage the latch housing when the cantilever arm is pivoted about the base member, the latch being actuatable between a latched configuration and an unlatched configuration;

wherein the latch housing comprises:

a guide plate adapted to be connected to the base member;

a slot formed through the guide plate and defining first and second end portions; and a notch formed through the guide plate at the first end portion of the slot, the notch extending downwardly from the slot;

and wherein the latch comprises:

an elongated latch plate adapted to be hingedly connected to the cantilever arm; and a sliding pin adapted to be disposed within at least one of the slot and the notch and adapted to slidingly engage the guide plate of the latch housing.

10. The kit as recited in claim 9, further comprising:

an actuating mechanism adapted to actuate the latch between the latched configuration and the unlatched configuration, the actuating mechanism comprising:

a spring arm adapted to be connected to the latch housing and adapted to contact the sliding pin of the latch;

an actuating lever adapted to be connected to the latch housing; and a spring adapted to be coupled between the actuating lever and the spring arm, wherein the actuating lever is adapted to place the spring in tension.

11. The kit as recited in claim 10, wherein, when the spring is placed in tension by the actuating lever, the spring arm is adapted to urge the sliding pin of the latch out of the notch and into the slot, thereby actuating the latch from the latched configuration to the unlatched configuration.

12. The kit as recited in claim 10, wherein the latch housing further comprises a protrusion formed on the guide plate between the slot and the notch, the protrusion being adapted to prevent, or at least obstruct, the sliding pin of the latch from being urged out of the notch and into the slot by the spring arm of the actuating member.

13. The kit as recited in claim 9, wherein, when the latch is in the unlatched configuration, the sliding pin is disposed within the slot and permitted to slide longitudinally between the first and second end portions thereof, thereby permitting the cantilever arm to rest in the loading configuration; and wherein, when the latch is in the latched configuration, the sliding pin is disposed within the notch, thereby maintaining the cantilever arm in the transporting configuration.

14. A method for transporting a waste container, the method comprising:

providing a transport device, the transport device comprising:

a base member;

a latch housing connected to the base member;

a cantilever arm hingedly connected to the base member and adapted to pivot thereabout; and a latch hingedly connected to the cantilever arm and adapted to slidingly engage the latch housing when the cantilever arm pivots about the base member;

placing the cantilever arm in a loading configuration, in which the waste container is adapted to be coupled to the cantilever arm;

coupling the waste container to the cantilever arm while the waste container is situated on a surface location; and placing the cantilever arm in a transporting configuration, in which the waste container is elevated above the surface location by the cantilever arm;

wherein the latch housing comprises:

a guide plate connected to the base member;

a slot formed through the guide plate and defining first and second end portions; and a notch formed through the guide plate at the first end portion of the slot, the notch extending downwardly from the slot;

and wherein the latch comprises:

an elongated latch plate hingedly connected to the cantilever arm; and a sliding pin disposed within at least one of the slot and the notch, and adapted to slidingly engage the guide plate of the latch housing.

15. The method as recited in claim 14, wherein placing the cantilever arm in the transporting configuration comprises:

pivoting the cantilever arm about the base member until the sliding pin reaches the first end portion of the slot; and placing the latch in a latched configuration, in which the sliding pin is disposed within the notch, by permitting the sliding pin to fall into the notch when the sliding pin reaches the first end portion of the slot.

16. The method as recited in claim 15, wherein placing the cantilever arm in the loading configuration comprises:

placing the latch in an unlatched configuration, in which the sliding pin is disposed within the slot and permitted to slide longitudinally between the first and second end portions thereof; and pivoting the cantilever arm about the base member until the sliding pin abuts the second end portion of the slot.

17. The method as recited in claim 16, wherein the transport device further comprises an actuating mechanism connected to the latch housing, the actuating mechanism comprising:

a spring arm connected to the latch housing and adapted to contact the sliding pin;

an actuating lever connected to the latch housing; and a spring coupled between the actuating lever and the spring arm, wherein the actuating lever is adapted to place the spring in tension.

18. The method as recited in claim 17, wherein placing the latch in the unlatched configuration comprises:

placing the spring in tension via the actuating lever such that the spring arm urges the sliding pin of the latch out of the notch and into the slot, thereby actuating the latch from the latched configuration to the unlatched configuration.

19. The method as recited in claim 18, wherein the latch housing further comprises a protrusion formed on the guide plate between the slot and the notch, the protrusion being adapted to prevent, or at least obstruct, the sliding pin of the latch from being urged out of the notch and into the slot by the spring arm of the actuating member; and wherein placing the latch in the unlatched configuration further comprises applying an external force to the cantilever arm, thereby permitting the spring arm to urge the sliding pin of the latch out of the notch and into the slot.

* * * * *